United States Patent [19]

Reuting

[11] 3,949,332

[45] Apr. 6, 1976

[54] RAPID ACTION RELAY

[75] Inventor: Hans-Werner Reuting, Peine, Germany

[73] Assignee: Elmeg Elektro-Mechanik GmbH, Peine, Germany

[22] Filed: July 3, 1974

[21] Appl. No.: 485,322

[30] Foreign Application Priority Data

July 9, 1973 Germany ..... 2334838
Aug. 29, 1973 Germany ..... 2343444

[52] U.S. Cl. ..... 335/81; 335/128; 335/179; 335/229

[51] Int. Cl.² ..... H01H 51/22

[58] Field of Search ..... 335/81, 78, 79, 82, 83, 335/84, 85, 86, 128, 177, 178, 179, 180, 181, 182, 229, 230, 234, 276

[56] References Cited

UNITED STATES PATENTS

| | | | |
|---|---|---|---|
| 3,211,858 | 10/1965 | Juptner | 335/80 |
| 3,321,722 | 5/1967 | Cohen | 335/128 |
| 3,534,307 | 10/1970 | Spewock et al. | 335/179 |
| 3,634,793 | 1/1972 | Sauer | 335/78 |

*Primary Examiner*—Harold Broome
*Attorney, Agent, or Firm*—Ralf H. Siegemund

[57] ABSTRACT

The relay as disclosed has a pivotable armature with self-balancing action and electromagnetic action, which produces uniformly directed position changing action.

19 Claims, 4 Drawing Figures

RAPID ACTION RELAY

BACKGROUND OF THE INVENTION

The invention relates to an electromagnetic relay including an armature being of the type that is, for example, adapted to adhere in the non-excited state to permanently magnetized poleshoes and contact springs actuated by the armature.

Magnetically polarized relays of this type are known. In such a case one or more permanent magnets are introduced into the magnetic circuit or circuits. The permanent magnet generates a flux in each of two magnetically conducting paths, which can be completed via an armature. In order to be able to move the armature and the contacts actuated thereby from one position to the other, an excitation field generated by a relay coil is superimposed on the field due to the permanent magnet. The advantage of such a relay resides in the fact that after switching over the contacts remain in their switch position owing to the adhesive forces due to the permanent magnet or magnets, without any need for further external exitation of the relay coil.

In order to ensure trouble-free functioning of such relays, care must be taken to ensure that on the one hand the sum of the magnet forces - i.e. the forces exerted by the permanent magnet or magnets on the armature - and the spring forces at any position of the armature always works in the direction of the poleshoes nearest the armature. This total force must be particularly large, especially at the two end positions of the armature, otherwise there is no guarantee that the armature would adhere properly in its position of rest. Although at some distance from the poleshoe, the total force decreases, it should not change its sign; otherwise, when lifting away only slightly from its end position and subjected to a mechanical shock, the armature could not be relied on to return to its end position and the switching position would change, a state of affairs which should not be brought about by mere mechanical shock. On the other hand, care must be taken to ensure that the sum of the excitation force - i.e. the force resulting from the excitation and the permanent premagnetization and acting on the armature depending on the position thereof - and the spring force works in such a direction during the whole of the stroke of the armature that it continues to the other end position. Only in such case do, in fact, forces obtain an excitation over the whole stroke of the armature, causing it consistently to move in the same direction. These conditions in respect of the permanent magnet force, the spring force and the excitation force are met when the curve of the spring force exerted on the axle determining the path of the armature lies between the curve of the permanent magnet force and the curve of the excitation force, without any of these curves intersecting.

With conventional relays, attempts are made in the interest of higher sensitivity to bring the curves of permanent magnet force and excitation force as close as possible to one another. These latter curves represent magnetization force vs. armature displacement. As however the (reflected) curve of the spring force must lie between them, it must be very accurately adjusted to the shape of the curves of the two magnetic forces. The spring characteristics must not intersect the magnetization vs. displacement characteristics as such intersection would mean a reversal of forces acting on the armature. As the magnetization curves are normally sharply curved, attempts have been made to effect this adjustment by the use of progressive springs which are difficult to manufacture. More often the rapid increase of the magnetic forces, as the end stop position is approached, has simply been limited by giving the magnet system the highest possible internal resistance.

A high internal magnetic resistance is achieved in the first place by the use of a permanent magnet of considerable effective length, thus making it needlessly bulky and expensive, and/or by operating the soft iron magnetic circuit at a high magnetic saturation, and/or by introducing into the magnetic circuit an additional air gap apart from the actual working air gap. By these means the shapes of the curves of permanent magnet force and excitation force are made flatter, so that one can make do with simple springs having linear characteristics.

A serious drawback of such high internal magnetic resistance resides in the tight spacing between the curve of the spring force from the curve of permanent magnetic force on the one hand and from the curve of the excitation force on the other hand, the latter representing the total effective force in the circumstances of electromagnetic energization of the relay. In the non-excited condition, the relay has little holding power when the armature is in the end stop position and is available for small power returning the armature to that position, if it has been lifted off e.g. on account of vibration. When the relay is excited, a small quantity only of energy is imparted to the armature, so that not only is the switching time prolonged, but most important of all, the speed with which the contacts open is slowed down, which increases the degree of burning of the contacts and consequently leads to a shortening of the useful life of the relay.

The feature which has the most decisive disadvantageous effect is the fact that the excitation flux also has to pass through the relatively elongated permanent magnet having a soft iron magnetic circuit operated at high saturation and/or through the additional air gaps, which requires a disproportionately greater magnetic flux to overcome these magnetic resistances and nullifies the gain in sensitivity aimed at and, consequently, results in a comparatively insensitive relay.

Relays constructed under the above-described principles thus result in construction which, despite considerable attention devoted to adjustment, are sensitive to shock and have a relatively low switching speed, because the magneto-motive forces in the working air gaps were, in fact, kept at a very low level; nevertheless, the relays are comparatively insensitive, because a very much greater proportion of the excitation magnetic flux is uselessly dissipated in the magnetic circuit. The drawbacks of the known methods are, however, much more far reaching, as has been disclosed in numerous publications concerning efforts to remove these drawbacks.

The risk of intersection of relevant characteristics becomes greater the more attempts are made to render the relay more sensitive in this way, i.e. by bringing the curves of permanent magnetic and excitation force closer together. If, in fact, the curve of permanent magnetic force is shifted to lower levels owing to leakage of the magnetic properties or the like, the curves intersect immediately. This has lead to numerous efforts to compensate the magnets by temperature compensation etc. which is a very arduous procedure. Intersection of curves similarly occurs between the mirror image of the curve of the spring force and the curve of the electromagnetic excitation force, if during the operating period even only moderate burning of the contacts takes place. During burning of the contacts, the points of contact making and breaking actually shift, i.e. the points en route to which the spring forces are decreasing to zero so that during this time the springs are subject to decreasing tension. Consequently, the spacing between the mirrored spring force curve and the permanent magnet curve and consequently latterly the adhesive foce becomes larger, while the spacing from the excitation force is exceeded.

The shifting of the curve or characteristics of spring pressure due to burning at the contacts is highly undesirable, since any permanent adjustment is out of the question. Moreover, when using a progressive spring system, the characteristic of which is continually changing, it is never known exactly where the intersection will arise. If it is situated in the vicinity of the armature and stop positions, the relay does not switch at all. If it lies somewhere between the end stops, then the relay is uncertain in operation. A mere shock or friction may cause it to fail and the armature will come to rest in an unwanted switching position. This faulty operation happens usually where the contacts remain closed under the smalles contact pressure.

If the armature does not come to rest, it will move in a sporadically, creeping fashion. If the contacts are operating under a high loading such creeping has a particularly disastrous effect on their condition. In order to avoid intersection of spring and magnetization characteristics resort is had to higher excitation capacities, but then the operating voltage must be readjusted from time to time by the user. This is a very unrealistic requirement. Consequently, when attempting to work at the specified and advertised response sensitivity, suitable additional precautions have to be taken at the outset, so that the lower excitation loading which is usually bought at considerable expense cannot be made use of at all.

It follows from the foregoing that the adhesive force cannot even be stated with any degree of reproducible accuracy with such relays. The response sensitivity can be defined with some sort of accuracy only, because it depends only in part on the magnetomotive driving power and is determined to a predominating extent by the resistance of the magnetic circuit. The result of this is that when operating at levels above or below the rated excitation, it is quite impossible to predict how the relay will behave, because, - especially when manufacturing tolerances, saturation phenomena, the temperature dependency of the material from which the magnetic circuit consists come into play - an indefinite fraction only of the excitation power can be made effective for the generation of magnetomotive force. The adhesive force and relay behavour are the less defined with regard to changes in the response excitation, the greater are the efforts made to adjust the shape of the curve of spring power to the shape of the curve of permanent magnet force, in order to make the relay sensitive. Fluctuations in the permanent and / or spring power of a few percent give rise to considerable variations in the adhesive force and also of the effective excitation required, owing to the effect of the disparity.

However, all such relays which have been made sensitive by causing the curve of spring force to conform closely to the curves of permanent magnet force and the excitation force have the fundamental drawback that over long stretches of the stroke of the armature the difference between the spring force and the excitation force is small, causing the force/stroke-integral, which defines the kinetic energy transmitted to the armature, to be small. This once again means relatively slow switching times and low speeds of contact separation.

For reasons of symmetry, relays with permanent magnetization and particularly for pulse operation and depending on direction of energization upon the desired switching state to be attained, are constructed with a swivel or pivotal armature, wherein each end of the armature abuts to poleshoe structure in each of the two switching states and positions; that is to say, such abutment is supposed to occur; otherwise the adhesive force will differ from the desired condition.

Journalling of the pivotal armature is absolutely necessary in numerous applications, invariably for example when importance is attached to signal sequence-controlled contact. On the other hand, however, owing to the journalling of the pivotal armature, the problem arises that when it is in contact with two of its abutting surfaces, the position of the armature is invariably over-defined or controlled from the static point of view. This is because in such a position the armature is not only supported at its pivotal axis, but also by the abutting surfaces, resulting, therefore, in a three-point support.

It may now happen that the rotational axis of a pivotal armature so mounted in a relay is not in absolutely accurate alignment with the abutting surfaces; the armature does not, therefore, come into perfect contact with the abutting surfaces so leaving undesirable gair gaps. Manufacturing and assembly tolerances must inevitably be taken into account during the manufacture of such relays and as a rule there is no guarantee that the rotational axle of the pivotal armature will, in fact, be accurately journalled in its bearings. On the other hand, however, it is usually very difficult to correct the disposition of the rotational axle, particularly when the pivotal armature is mounted in an aperture made in the carrier carrying the relay coil.

It can readily be seen that uncertainty in the engagement between both ends of a swivel armature and the poleshoes, compounds the problems regarding magnetic attraction vs. displacement characteristics as outlined earlier.

DESCRIPTION OF THE INVENTION

It is an object of the present invention to provide for a new and improved relay which combines balanced operation with rapid action.

It is another object of the present invention to provide a relay biased by means of permanent magnetization and in which the holding action of the bias is readily overcome upon electromagnetic energization.

It is still another object of the present invention to provide a relay in which the holding force is the resultant of permanent magnetic bias and (subtractive) contact pressure as provided by resilient reaction of spring biased contacts, wherein the contact pressure force will never exceed the bias.

It is a further object of the present invention to provide a relay with balanced action pivot or swivel armature.

It is a still further object of the invention to provide a new and improved relay having a swivel armature whose ends are to abut poleshoes in both of two switching positions with certainty. It is a particular object of the present invention to improve a relay with permanent magnetic bias, energizing coil and resilient contact loading for a pivotable or swivel armature having two switching positions and changing positions by particularly directed current pulses through the coil.

In accordance with the preferred embodiment of the invention, it is suggested to provide a relay of the type referred to above with such a magnetic circuit having a yoke structure which, in combination with a permanent magnetic bias and the armature, has a characteristic of attraction which is highly nonlinear, with little attraction in median positions between two stop positions of abutment of the armature with the yoke structure, and very strong attraction when in the vicinity of the stop position. The coil is to be energized so that the magnetic attraction is just overcome when the armature is in one or the other stop positions and is propelled from that position towards the other one. The contacts as engaging in either stop position are resiliently biased, tending to remove the armature from the respective stop position, and upon electromagnetic energization the propelling force of the latter is added to the spring force of the spring bias and loading. The resilient reaction characteristics of the spring contacts varies preferably linear with displacement and for the ranges of contact making, and these characteristics are preferably tangent or close to the characteristics of permanent magnetic bias without electromagnetic energization. The armature has a shaft and is journalled in excentric disks to obtain self-balancing of abutment of both ends of the armature with the yoke structure, in both stop positions.

Broadly speaking, it is suggested to provide for a magnetic reluctance of the magnetic circuit, as far as established by the ferromagnetic material, which is very small as compared with the magnetic reluctance in the operating air gap as between poleshoes and armature, using here large cross-sections and, possibly, magnetic shunts running parallel to the permanent magnet that biases the magnetic circuit. Specifically, the total reluctance through solid material of the magnetic circuit should not exceed 1/5 of the reluctance in the working air gap. Preferably, the ratio should be even smaller than 1/10. The electromagnetic energization is selected so that the armature will be accelerated at maximum possible force, particularly between the period of lifting from an engaging disposition up to the point of contact opening. In particular, the resulting magnetic force, composed of permanent magnetic force and electromagnetically produced force, should not change direction upon turn-on of the electric current in the relay coil but should act in the same direction as the now relaxing contact spring or springs accelerate the armature towards a contact opening disposition and the alternative switching state.

It will be appreciated that symmetry of operation will depend to a considerable extent on comparable disposition of the armature arms in relation to the yoke structure, and here particularly regarding abutment of both arms in both of the two stop positions. If the armature is journalled in excentric disks, this balance in position can be obtained by rapid action alternation between the two armature position, thereby shifting the journal axis until both armature ends do abut the yoke structure in both switching positions. In any situation where the armature abuts the yoke structure with one arm only, the point of abutment acts as fulcrum and acts strongly on the journal disk. Rapid action rocking of the armature will result in a torque on the disks for turning them thereby shifting the journal axis until both arms of the armature abut the yoke structure in each stop position.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
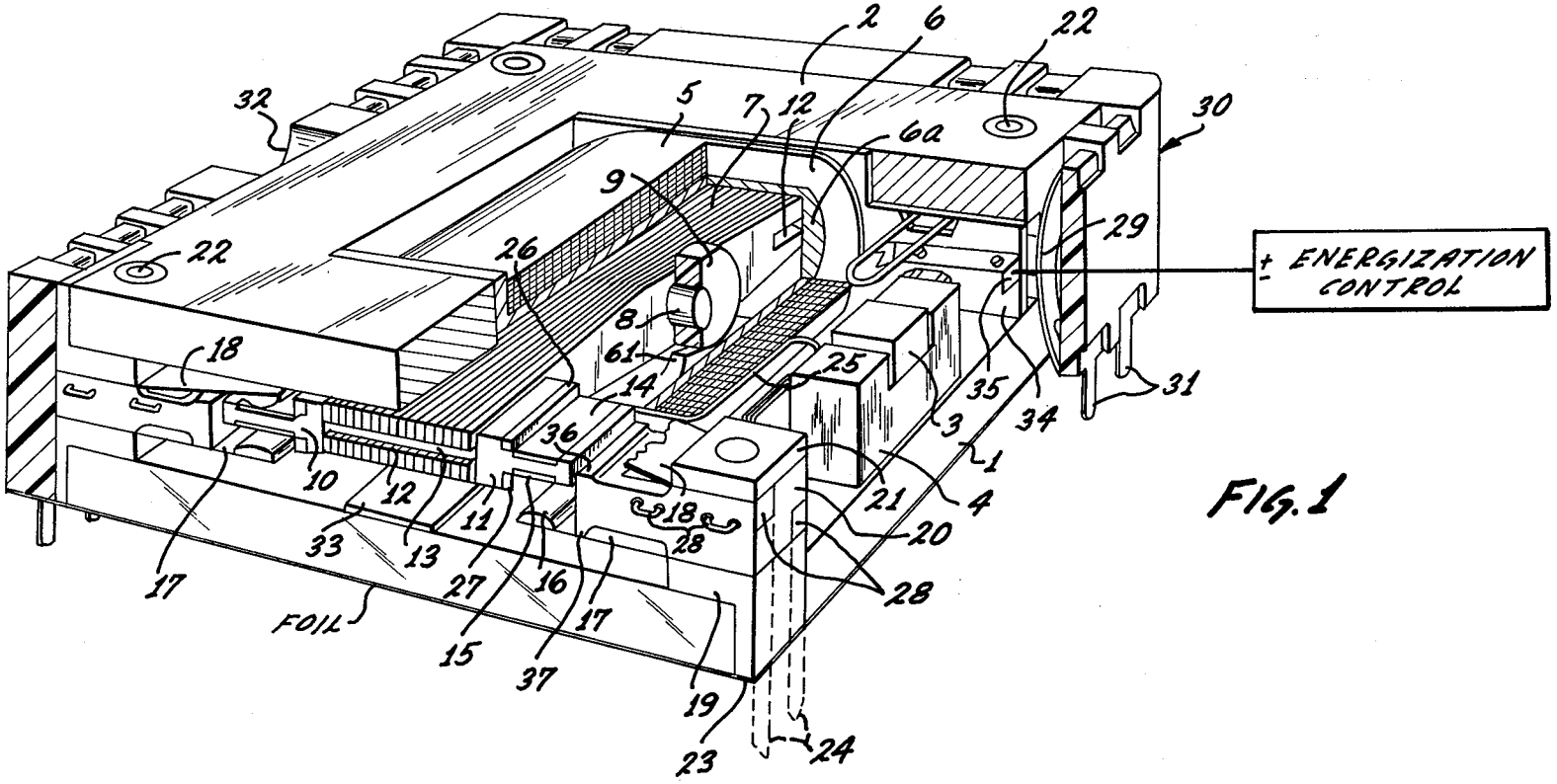
FIG. 1 is a perspective view of a relay in accordance with the preferred embodiment of the invention showing partially broken open portions to permit viewing of the interior.

Proceeding now to the detailed description of the drawings, the relay illustrated has two quadrilateral yokes 1 and 2, which could be regarded as rings or annuloids of rectangular contour, each yoke having four legs accordingly. A permanent magnet 3 and an intermediate piece 4 is disposed between two adjacent legs of yokes 1 and 2, there being a corresponding assembly interposed between the two oppositely located legs of the two yokes. These intermediate pieces 4 function as spacers and are quite accurately machined. The same is true for the magnets 3, so that the distance between the two yokes 1 and 2 is accurately determined therewith.

A bobbin or coil carrier 6 is disposed in the open space in and as between the central portions of yokes 1 and 2; this carrier 6 carries an energizing coil 5, while a pivoting armature 7 is disposed inside of bobbin 6. Armature 7 has a shaft or axle 8 for journalling the armature in plastic aperture disks 9. These disks are mounted in carrier 6. The armature 7 can pivot in one or the opposite direction and its extremeties or arm ends can engage diagonally opposed yoke legs, serving as pole shoes accordingly.

As all parts are circumscribed by the yokes, they can generally be made relatively wide especially in the region of the permanent magnets, so that the thickness of the latter which must be of a definite volumetric capacity, can be kept relatively small. This offers a number of significant advantages; among them is that these permanent magnets may have a relatively low magnetic internal resistance, which is important from the point of view of increasing the sensitivity of the relay. Since the permanent magnets are actually situated in the magnetic circuit of the excitation flux, that flux would have to be made greater in proportion to any increase in the magnetic resistance in the magnetic circuit.

The gap between the two yokes needs only be partly filled by the flat permanent magnet 3, the remainder being occupied by soft iron parts 4. In such a case, the thickness of the permanent magnets and that of the soft iron parts determines the spacing between the yokes 1 and 2. In view of the ample space made available by the use of wide yokes, the soft iron parts may in this case be designed so as to form a magnetic shunt; by this means the smallest possible magnet volume and the lowest possible internal resistance of the permanent magnet system situated between the yokes may be arrived at for a given relay by suitable optimization.

The two ends of armature 7 each carry two laterally extending contact actuators 10 and 11, made e.g. of plastic material. These actuators are secured to the respective armature arm by means of a magnetizable rod or bar 13, which is inserted in a slot 12 at the particular armature end. Each of the actuators 10 and 11 has a contact surface 14 on its respective upper or top side, and another contact surface 15 on its lower side. Hence, these contact surfaces are moved up and down on pivot motion by the armature 7 and constitute non-captive contacts. The entire arrangement has eight such contact surfaces, the sub-assembly as illustrated in the front of the perspective illustration is dublicated in the rear.

Each contact surface on the rocking or pivoting armature cooperates with a stationary contact 16 having curved, cylindrical contour as facing the respective armature contact. Contacts 16 are stationary in the sense that they are not mounted on the armature, but they are displaceable due to mounting on leaf springs, such as 17. A leaf spring 18 is shown partially, carrying also a contact, such as 16 which cooperates with a contact surface 14 on an upswing of the armature.

Due to the swivel, pivot or rocking motion and displacement of the armature, one arm of the armature will deflect two springs 17, while the other arm deflects two springs 18, with a reversal of deflection action on pivoting to the respective other position. The illustrated position of the armature shows the end which is visible in the front due to perspective illustration, in up position, so that contact carriers 10, 11 deflect the two visible springs 18. The rear end of the armature is down accordingly and has deflected the two springs corresponding to 17. Each armature end does not abut a yoke leg directly, but sits on a stop sheet 33.

The relay has four corner assemblies, one assembly being shown in greater detail and being comprised of spacer pieces 19, 20 and 21, These leaf springs 17 and 18 are secured to these spacer assemblies. These assemblies actually serve as mounting structures in that rivets, such as 22, hold spacer assemblies and yokes together in the four corners. The springs are mounted with the assembly in that fashion and the rivets force super-imposed parts together. Not all of the spacers 19, 20, 21, springs 17, 18 and yokes 1 and 2 have all of the illustrated recesses and protrusions in all four corners.

One protrusion or extension is, for example, flange part 23 being inserted in an appropriate recess in the one corner of yoke 1 and providing also electrical insulation relative thereto. Rear end continuations 24 of the contact springs may be run down at that point. The spacer 21 may be provided with a similar flange inserted in a recess in yoke 2, but that may not be necessary.

THe contact springs 17 and 18 have similar contour each with a laterally offset rear extension 24 and since the contacts 16 of two springs 17, 18 face each other, the narrower extensions 24 have necessarily a lateral distance from each other. Since in this manner the width of such a contact spring extension 24 is inveriably only a small fraction of the width of the springs themselves, in the case of facing contact surfaces of two springs, the extensions thereof are always spaced from one another, which ensures trouble-free electrical connection. If in this connection two contact springs 17, 18 with facing contacts 16 are provided at each corner of the relay, all springs mounted at the corners have coincident contours, so that only a small number of different components are required, which brings further advantage to the sandwich method of construction. Should more than two contact springs with facing contact surfaces be required at the corners, the extensions or leads can be mounted at right-angles to the longitudinal edges of the contact springs, so that they can then be led out by another lateral surface of the relay.

The rivetting of the yokes to each other provides also for positive positioning of carrier 6 inside of the structure. The carrier has projections, such as projection 34 of the coil flange bearing against the yokes 1 and 2. The particular projection 34 is also provided with an electric connection 35 for coil 5 runs to the outside of the assembly.

Each contact surface 14 and 15 is connected to an elongated supple spring, such as 25, running parallel to the armature and providing current to the respective contact surfaces. The spring doubles back and is run to the outside through the respective, associated corner piece 20.

Each actuator 10 and 11 has additionally two permanent magnetics 26 and 27 providing one magnetic flux component in direction of the respective contact surfaces 14 and 15. These particular flux components establish a force acting on an arc or spark between a contact surface on the one hand and its respective counter contact 16 on the other hand and in direction of longitudinal extension of that counter contact so as to drive the spark in axial direction as far as the cylindrical contour of the contact 16 is concerned. Therefore, such an arc will not remain stationary at the point of development and will not burn a hole. Rather the arc will migrate along the contact surfaces and will not unduly heat anyone spot. Damage is avoided or at least minimized by such a provision.

In lieu of the two small permanent magnet rods 26, 27, one can construct rod 13 as permanent magnet. Still alternatively, if the rod 13 is made of soft magnetic material, stray and leakage flux can be put to use and is appropriately run into such rod to obtain the same effect of moving an arc over the contact surfaces.

Owing to the relatively large cross-section of the yokes and of the armature made possible by the construction and technique of the invention, permanent magnets do not produce any detrimental effects on the constant actuating members in respect of a too rapid saturation of the flux path provided for the adhesion of the pivotal armature and for the actuation thereof.

The ends of contact springs 17 and 18 as well as of springs 25 are all constructed to lead to connections 28 in and at the respective closest corner element 20. These connections 28 may be connected to or engage springs 29 of a plug connector 30. The connector 30 is constructed as a frame into which the entire relay yoke structure has been inserted. The springs 29 are equipped with soldering pins or lugs 31, which can be soldered onto a printed circuit board.

The plug connector 30 is constructed as a frame and has an adequate dimensions for receiving the yokes as riveted together. The height or depth of that frame should not exceed the height of the yoke assembly. This way, no additional head room has to be provided for, the frame 30 as circumscribing the yoke assembly encases the yoke assembly and the top and bottom opening of the yoke structure may be covered by a thin foil.

The yoke assembly may be just stuck into the frame, and two of its sides cover the laterally open space between those yoke legs which serve as pole shoes. Two opposite sides of frame 30 have recesses 32, so that the yokes as assembled can be gripped by at least one yoke, so that the yoke assembly can be removed from the frame.

The legs of the yoke themselves cover all contact-making parts of the relay and are relatively wide. This wide construction does not only serve as protection, but the permanent magnets 3 may also have very large base surfaces and offer, therefore, very small internal resistance (reluctance). As stated, the magnetizable spacers 4 provide for a magnetic shunt path which reduces the magnetic resistance regarding energizing flux still further, while the volume of magnetized material is quite small. The sensitivity of the relay benefits greatly from this feature.

Another advantage of the wide yoke legs is that the rocking or swivel armature can be correspondingly wide. The operating air gap between armature and yoke legs has, therefore, quite a wide surface, and magnets of small height can be used which in turn renders the relay quite powerful, particularly with regard to contact pressure forces.

The wide armature and the wide actuators displace a relatively large amount of air when actuated. The armature is caused to pivot from one end position to the other one. If the relay construction is laterally closed that air must flow from one armature arm along the space between the contacts to the other arm. This flow dilutes the ionized plasma of a spark or arc and provides also for cooling of the contact surfaces along which such air is forced to flow. Still, residual air between the large surfaces which are moved towards each other cushion the impact of the respective armature end on the yoke. The separation or stop sheet 33, moreover, prevents direct impact on the yoke. This cushioning extends the life of the relay and of its contacts, and prevents bouncing of the armature as carrying contacts, so that contact bouncing on account of armature-yoke impact is impeded, indeed.

The wide construction of the yoke legs permits also utilization of wide springs 17 and 18. Hence, a relatively large quantity of air is present between each spring and the nearest yoke leg. This air dampens any displacement of the contact springs 17, 18 and that in turn impedes bouncing of the respective relay contacts. Besides, the springs are quite short and have accordingly a high spring resilient spring constant while contact pieces 16 plus spring have comparatively small mass. The relevant factors of such an oscillating assembly are, therefore, mutually reinforcing as to damping and are quite poor in performance for setting up of oscillations. The air cushion imposes additionally strong attenuation of mechanical oscillations, so that, indeed, there will be little, if any flutter and bouncing.

The contact surfaces 14 and 15 are secured to the armature in a manner which does not permit oscillations relative to the armature. The springs 25 are to have little resiliency. Thus, the armature plus contact actuators constitute an oscillation system, which is characterized by large mass and large magnetic forces. The effective inertia of the armature is so large, so that in the instant of impact of the contacts 14 or 15 on contacts 16, armature 7 continues its displacement, practically unimpeded. The large armature precludes all bouncing at this point. As the armature hits the yoke, i.e. stop sheet 33, maximum magnetic force exists in the circuit. These attracting forces hold the armature against reflective bouncing. Moreover, the air cushion did reduce the kinetic force of the armature right before the impact. Even a slight bouncing of the armature will not be effective and will be compensated by the resiliency of the mount of contacts 16, only the deflection of springs 17 and 18 may vary slightly but without causing the contacts to disengage and reopen.

It should be noted that one can increase the attenuation of springs 17, 18 still further by providing the corner elements 19 and 21 with inward projections to confine the air adjacent springs 17, 18 still further, so that more tortuous paths for air between springs and yokes are provided therewith, and cushioning is enhanced accordingly.

Still further increase of contact spring damping is possible by placing e.g. a foam material between springs and yoke, filling that space and cushioning any spring deflection still further.

The corner pieces 20 are constructed to prevent springs 17 and 18 from following the contact surfaces 14 or 15 upon opening action of the relay contacts. For this, ridges 36, 37 are provided on an inward extension of corner piece 20. These ridges shorten the spring arm length to such an extent that they hold the spring with contact 16 in position particularly upon opening contact action. These stops do not interfere with desired flexing of each contact on a spring 17 or 18 once engaged, and as the armature continues to move until hitting a pole shoe—stop sheet, the flexing of the springs 17, 18 produces the desired contact pressure.

An advantageous feature of the uni-directional resiliency as imparted by the stops 36, 37 upon the contacts 16 on springs 17, 18 is that upon abutment, they will open rapidly without tendency to reclose once disengagement has been effected, as the stops impede further movement of contacts 16. On the other hand, the contacts may be welded and together! As the armature pivots to switch over, the springs welded to one or more of the corresponding contact surfaces provided on the contact actuating members 10, 11 can only be carried by said contact surfaces as far as the stops on the middle spacer piece will permit. At this moment any further armature movement is blocked, if the axle thereof is mounted with sufficient play. Accordingly, the oppositely facing contact surfaces on the contact actuator, not being welded, cannot touch their counter-contacts 16 and thus no previously open contacts can be closed.

Turning now to specifics of mounting of the armature, shaft 8 is preferably a magnetizable rod inserted into the usually laminated armature to provide positive support for the armature but without any significant interference with the magnetic flux in the armature.

At least the ends of the shaft are round for journalling in the disks 9. There should be no play between rod 8 and armature 7, so that keying here is advisable. The disks 9 are made of plastic and provide some resiliency in the mounting of the armature in coil carrier 7.

The armature ends are pulled against yoke legs in each end position by means of rather strong magnetic forces as stated above. If the armature shaft is not accurately positioned, only one end of the armature could positively engage the respective stop sheet 33, while the other arm end may still have a certain distance from the respective yoke leg and particularly from its stop sheet. This unbalanced state of armature abutment would produce an additional and undesired air gap at that point. Moreover, the one-sided support of the armature on the yoke would load the shaft 8 under lever arm action (at about half the lever length as measured from one end to the other) and at twice the action force effective between the engaging armature end and the respective yoke leg. Moreover, when both armature ends are not abutting the respective stop sheets, the magnetic balance of the system is disturbed and the flux distribution will not be symmetrical. It is for this purpose that the shaft 8 is journalled in disks 9 which have an excentric configuration, that is to say, these disks have a non-concentric circular periphery with regard to the respective journal aperture. This way, the disks will turn inside carrier 6 until both ends of armature abut the respective yoke legs, and no pressure is exerted on the axis.

Some details should be considered concerning placement of disks 9 inside of coil carrier 6. The carrier 6 is open to both sides to place the armature inside of the carrier. The openings face respectively the poleshoe gap as between those yoke legs against which the armature will abut. Of course, the armature ends will project always outside of carrier 6.

One of these openings in carrier 6 can be used to shift the disks 9 into the coil carrier, until abutting suitable stops, such as 61, provided e.g. as cut-outs, recesses, flanges, snap action stops or the like. These stops 61 prevent further shifting of disks 9, but permit their turning. In lieu of stops behind which the disks are placed by snap action, one could provide rails inside the carrier 6, which have been shifted into the interior of carrier 6 laterally (i.e. through the openings as provided for having the armature ends project out of the coil carrier). These rails are then fixed on the outside. The rails are constructed e.g. as two metal strips for each disk, and the disk is held in-between. After the rails, disks and armature have been shifted together into the carrier; they are fixed through fastening either to the coil carrier itself or to the yokes. One could also use a single rail for each disk with a blind bore for holding the disk. The mounting on rails is preferred as the friction between such mount and the disk is quite low.

After the disposition of the disk 9 has been adjusted as stated, one arm of the armature abuts stop sheet 33 on the one leg of yoke 1 while the other armature arm abuts the corresponding sheet on the diagonally opposed leg of yoke 2. This does not mean that both of the armature arms will respectively abut the respective other two yoke legs when the armature is being placed into the other end position! Such abutting position is obtainable if, in fact, the excenter disks turn also on each switching action; that, however, is not desirable.

In order to avoid disk turning on each armature pivoting, it is suggested to obtain proper adjustment by operating the relay at a rapidly varying energization in an initial adjusting procedure. This, in effect, produces shaking in the armature mount and will cause the excenter disks to assume a median position from which abutting armature dispositions are obtained for each and both of the two switching and end positions. Such self-adjustment will occur even if the magnetic forces are comparatively small and if friction of disks 9 in cradles 6a is high. The large inertia of the armature when actuated will, indeed, overcome friction, and rapid action will turn the disk 9, thereby pivoting the armature axis, until the forces acting on the armature and on shaft 8 in both switching positions will be equalized.

Pursuant to the rocking adjustment, the axis of the shaft 8 will assume a median orientation with regard to both end positions of the armature. It may then be advisable to place a curable glue adhesive between disks 9 and casing or carrier 6, which hardens during the rapid action armature operation so that the position of the disks 9 will be fixed and retained particularly after the rapid action adjusting operation has been terminated. The disposition of the armature axis is now fixed particularly for normal switching operations which will follow.

The adjustment of shaft 8 as obtained should not be influenced by elasticity of the coil carrier 6, or of the disks 9. Moreover, the shape stability of disks 9 must not be the cause for any elastic yielding of the carrier 6 particularly during the rapid action adjustment. Therefore, the carrier 6 is strengthened considerably in the bearing portions for disks 9. Moreover, that portion of carrier 6 bears against yokes 1 and 2. In particular, carrier 6 has two rather strong bars 6a extending in a direction transversely to the axis of shaft 8. These bars prevent flexing at the bearing locations of the disks. The bars **6*a* are rounded on the outside to permit more easy winding of the relay coils, particularly by automatic coil winding machines. Bars 6*a*** will actually extend beyond coil flanges and may be affixed (such as press fit through friction) between the yoke legs, serving as poleshoes, to obtain positive support of the coil carrier as a whole.

For purposes of adjustment one can replace the magnet forces by others or one can provide supplemental force here in order to better overcome any friction of the disk 9 when being turned in carrier 6. The result, of course, will be the same.

After having explained how the system is balanced as far as the armature dispositions is concerned so as to ensure abutment with stop sheets of each armature arm end in both end positions, I proceed now to the description of details concerning the magnetic interaction between armature and yokes on account of the permanent magnetization as modified by coil energization with added consideration given to the (nonmagnetic) force as exerted by the springs 17 and 18 onto the carriers 10 and 11 and how that effects the armature disposition and changes from one end position to the other.

The centrally provided permanent magnets provide flux into the yokes and armatures, so that armature ends can be held in abutment with legs of the yokes in each of two end positions. The armature is shown in FIG. 1 in one of these portions, whereby the visible front end of the armature 7 is held against the one leg of yoke 2, while the rear end of the armature (not visible) is held against the diagonally opposed leg, pertaining to yoke 1. The other position finds the front armature arm end down and the rear end up, whereby it is understood that "front" and "rear" have significance only with regard to the perspective illustration.

Electromagnetic energization through flow of current will cause the magnetization in the yoke-armature system to change only for one particular direction of current flow and for a given end position. The oppositely directed current is needed to move the armature into the that given position. Currents flowing so that the resulting magnetization merely reinforces the holding force as provided by the permanent magnetization will not cause the armature to change disposition. Since the relay has a permanent magnetization either switching state is maintainable without electromagnetization, so that the relay is pulse-operated.

Figure 2:
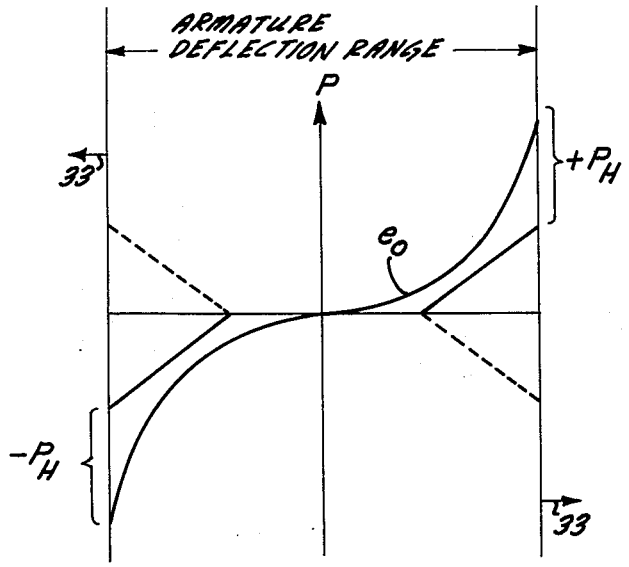
FIGS. 2, 3 and 4 are diagrams, in which force is plotted versus displacement of the armature.

FIG. 2 shows the force acting on armature 7 when coil 5 is not energized while magnetic flux is established in the magnetic circuit by the permanent magnets 3 only. The force is plotted over the entire deflection range of the armature from abutment with one stop sheet to abutment with the other one. The deflection path is plotted along the abscissa and with reference to a median position serving as zero point. Positive valves, for example, define an up position of the visible armature arm in the front of FIG. 1 and down stroke deflections from the median position of that arm end are plotted as negative values of the abscissa.

The vertical lines $S_1$ and $S_2$ respectively to the left and to the right of the graph, parallel to the ordinate denote (on the abscissa) the end positions of the armature, when, for example, its illustrated upper end abuts one of the stop sheets 33 ($S_1$).

The forces P as plotted on the ordinate have positive sign if directed towards upper end position of the visible armature arm end, tending to drive it up, which is to the right as far as positions on the abscissa are concerned; the negative sign denotes downwardly directed forces. The curve $e_0$ in FIG. 2 denotes the force set up by the permanent magnetization and acting on the armature; the curve particularly represents the variations of that force with different armature positions. This characteristic is highly non-linear. When in the median position, zero force acts on the armature and deflections not too far from the median position result in little attraction. On the other hand, the curve $e_0$ runs quite steeply for positions close to end positions of abutment to the stop sheets, so that the holding force for the armature is quite significant in either end position. This high non-linearity is the result of very low reluctance in the magnetic circuit. The solid material reluctance is preferably about 1/10 or smaller than the reluctance of the working air gap when the armature has median position; this reluctance ratio should not exceed 1/5.

The two dotted lines are spring force characteristics, whereby the one to the left in the graph denotes deflection force vs. displacement path of the springs 17 in the front and of the springs corresponding to 18 in the rear; the dotted line to the right denotes deflection of the springs 18 adjacent the armature end as visible in FIG. 1 and of the rear springs corresponding to 17. The points where the dotted lines intersect the abscissa denote, on the abscissa, the point of first (or last) engagement of the respective contact 16 with contact surfaces 14, 15. The intersection of the dotted lines with the vertical end lines $S_1$ and $S_2$ denote the spring force as exerted by and as effective between contacts 16, on the one hand, and contacts 14 and contacts 15 as engaged in each instance.

Please note that each dotted line represents the component action of all springs involved which are four in each instance. Specifically, the intersection of the left hand dotted curve with S, is the resultant spring force exerted on the armature by the two springs 17 adjacent the end of armature 7 as visible in the front of FIG. 1, and of two springs 18 adjacent the opposite end of the armature. It should be noted that the armature as illustrated in FIG. 1 in the opposite switching position, having been driven into that position by positive, upwardly directed forces, will be subjected to a downwardly directed spring force as determined by the right hand dotted line in FIG. 2, particularly where terminating and intersecting the right hand border line $S_2$. This spring force is established by the upwardly deflected springs 18 providing downwardly directed force and contact pressure, and additionally, the other end of armature has lower position and the springs, such as 17, at that end are deflected to provide upwardly directed force.

Armature 7 is acted upon by the sum of the force set up by the permanent magnets 3 and the forces of those of springs 17 and 18, which are deflected (springs 25 can be neglected). The resultant could be drawn also in the Figure, but a different way of illustration has been chosen. The spring action force characteristics have been plotted additionally in mirror image or reflected configuration (straight solid lines). The resultant force as acting on the armature, therefore, is the difference between the solid curves. The magnetic force should, of course, always be larger than the reaction force of the springs, so that the spring or springs merely reduce the force as provided by magnetic attraction. The specific differential forces $\pm P_H$ as plotted are effective on abutment of the armature on the stop sheets 33. Thus, the specific forces $P_H$ are the effective forces of attraction, holding the armature in either end position for zero electromagnetic energization, merely by permanent magnetic energization but as reduced by the contact pressure producing spring forces.

Figure 3:
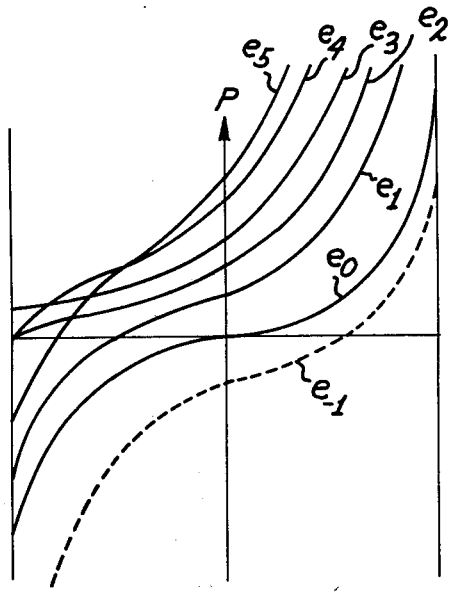

FIG. 3 shows the same curve of magnetic attraction $e_0$. The additional curves $e_1$, $e_2$ etc. represent resultant forces as they are effective on energization of the coil 5, whereby ascending indices denote increasing magnetization as electromagnetically produced. All these curves have validity upon driving current through coil 5 in one particular direction. This means that positive branches of these curves denote a direction of electromagnetic plus bias force tending to drive the armature to a position in a direction to the right along the abscissa, towards abutting position corresponding to $S_2$. However, these curves combine electromagnetic energization and permanent magnetic bias. Moreover, several of these curves have negative branches. Thus, an electromagnetic magnetization establishing e.g. characteristic $e_1$ by itself, will not be able to move the armature away from an end position as defined by line $S_1$ on the abscissa; such magnetization merely weakens the attraction as provided by the permanent magnetic bias. There are, however, certain energizations, such as $e_2$, $e_3$ and $e_4$ which overcome the attraction of the permanent magnetization. Higher energizations will overcome the permanent magnetic bias but holds the magnet by oppositely directed attraction (e.g. $e_5$).

Curve $e_{-1}$ illustrates the situation for a magnetization in the opposite direction. Curve $e_1$ is the point-symmetrical reflection of curve $e_1$, reflection being on the point of origin of the coordinate system. Higher magnetization, in the opposite direction, will exhibit analogous characteristics. Of course, such strict symmetry exists only to the extent symmetry is observed in the construction of the relay. The afore-described position balancing operation is instrumental in attaining that symmetry.

Upon comparing FIG. 2 with FIG. 3, one can deduce that the reflected spring force curve must be located between curve $e_0$ and a curve $e_n$ representing an energization that will move the armature from one position to the other one, while without such energization the armature will drop back to the same position it had been on energization O. In other words, the electromagnetic energization vs. displacement curve must be located so that at least its intersection with line $S_1$ is above the intersection of the reflected spring force curve with that line. Only then will a force be produced lifting the armature off the position corresponding to line $S_1$.

The reflected spring force curve and the effective energization curve should not intersect as that would reverse the sign and direction of resultant force as acting on the armature which would render the relay inoperative unless inertia would carry the armature through the (limited) zone of a reversed force. It is not to be recommended to rely on such action, because the armature mass is usually made as small as possible, simply for purposes of obtaining short response times for switching action. Large masses also invite stronger friction and are more difficult to handle as to impact.

Summarizing FIG. 3, the solid curves $e_1$ etc. have specific validity for electromagnetic energization when provided for causing the armature to move from a position corresponding to the line $S_1$ to the right. The coil 5 must provide oppositely directed magnetization ($e_1$) to obtain the reverse armature movement. Such movement is initiated by spring bias as the electromagnetization tends to weaken the holding force, and only in a few instances ($e_3$) will electromagnetic energization suffice by itself to overcome the permanent magnetic bias.

Electromagnets of the known variety use energization curves, such as $e_1$, so as to operate with as little power input for the relay coil as possible. This particular curve $e_1$ runs quite close to curve $e_o$ in the left hand portion, the disparity becomes significant only in the right hand portion of the figure. Generally speaking, the effective energization curve will approach curve $e_o$ for reduced energization of coil 5.

Upon inspecting the curves closely, it can readily be seen that it is quite difficult to find a spring force curve that could be placed between curves $e_1$ and $e_o$, without intersecting either. The difficulties are compounded by the fact that wear of the contacts is reflected in a change in the spring force characteristics. Also, ageing and temperature dependency of the permanent magnets cause changes in the contour of the curves, and the permanent magnets may differ from batch to batch, so that reproducibility of the several characteristics on a mass production basis is not guaranteed. Thus, curves which should not intersect may still intersect, possibly even after some period of successful operation.

In accordance with the invention, a different kind of energization field is being produced. As already mentioned above, a certain range of energization exists in which the magnetization alone has the same direction in the entire range of armature positions. One could say that these are energizations larger than $e_2$ but smaller than $e_4$. With such magnetizations, the armature would be electro-magnetically propelled to the other position even without support by the springs.

One can see from FIG. 3 that an optimum energization can be selected so that the armature receives maximum propulsion energy when lifting off the engaging position with a stop sheet 33. Specifically, maximum electromagnetic acceleration can be provided for the armature even when still in a position close to abutment with a stop sheet, but from which it is to be displaced. This way, one obtains maximum speed for changing contact connections. More particularly, one obtains maximum initial acceleration when, in fact, the armature is not just propelled by the spring force out of the previous end position, but if that movement is ab initio supported by the magnetic force. This way, sparks and arcs that may develop are interrupted shortly after their development which is significant for the life of the relay and its contacts.

Figure 4:
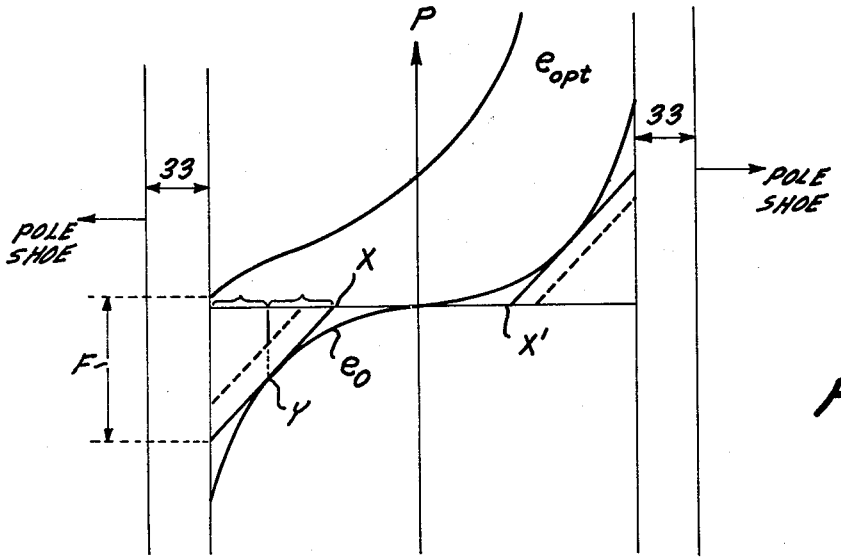

FIG. 4 shows a magnetization curve $e_{opt}$ selected as being all above the abscissa, that is to say the force as produced by combined coil energization and permanent magnetization has the same direction throughout the entire range. This curve $e_{opt}$ is chosen as a curve between $e_3$ and $e_4$ in FIG. 3. The reflected spring forces (on both ends) have been plotted as solid lines and also curve $e_o$. The points X and X′ denote the position of contact making/breaking; more specifically, the range between X and the left hand end position line $S_1$ denotes the range of contact making. When the armature is in positions to the left of X up to position X′, the contact is not made anywhere. In the range between X′ and the right hand end line $S_2$, the other contacts are closed.

It can thus be seen that the relay is not operated at an excitation level at which the curve of excitation force $e_{opt}$ is adapted to the maximum degree to the curve $e_o$ of permanent magnet force; on the contrary, a curve of excitation force has been selected which ensures the highest possible speed of separation of the contacts and concomitant therewith short switching times. Curve $e_{opt}$ has on the whole the greatest possible spacing from the curve $e_o$ of permanent magnetization as well as from reflected curve of spring force, for which purpose a substantially greater excitation magnetic flux must be made effective in the working air gap. Nevertheless, a higher degree of sensitivity of the relay is achieved, because owing to the extremely low magnetic resistance any additional magnetic flux which cannot be utilized is dispensed with. Due to the extremely low magnetic resistance of the magnet system, the curves of the permanent magnet force and the excitation force are more sharply curved and steeper than in the case of magnetic systems with a high magnetic resistance, so that by this means also curves of magnetic force are obtained through which a greater quantity of energy is transmitted to the magnetic armature 7 in the period between commencement and completion of separation from the stop than is the case with magnet systems with a high magnetic resistance. This holds directly for the curve of excitation force $e_{opt}$ and indirectly also for the curve $e_o$ of permanent magnet force, because the latter—as will be mentioned subsequently, determines the energy storage capacity of the springs 17 and 18.

The dotted lines in FIG. 4 denote reflected spring force characteristics as they may appear after some time of operation, when the contacts have been burnt a little. However, such shifted curves cannot possibly intersect the energization curve $e_{opt}$, so that the effective force remains unidirectional for the entire range of armature displacement.

Whereas with conventional relays in the first phase of the armature movement the excitation force has the same dragging effect as has the permanent magnet force in this region and the amount thereof was made less than the forward driving spring force, provision is made according to a further feature of the invention that the arrangement for excitation of the relay is such that on switching over the armature 7, the resulting excitation force on the armature always acts during the entire stroke in the direction from one stop ($S_1$, $S_2$) towards the other. By this means the effect is achieved that the force displacement path-integral of the excitation force curve $e_{opt}$ between contact of armature 7 with a stop sheet 33 and the instant of separation (X, X') of the contacts is considerably increase. The risk of intersection of the curve of spring force with the curve of excitation force is completely averted. Not only is the speed of separation of contacts brought to a maximum in this way but the switching time of the relay is extremely short as consequence, which does not necessarily follow therefrom.

FIG. 4 shows further that the spring force curves have been selected, so that the mirror image runs tangential to $e_o$. It is desirable to optimize these springs, so that they provide maximum propelling force. That is to say the spring characteristic is selected, so that its force acting on the armature in an end position is quite large ($P_H$ being small accordingly). The force F available for moving the armature out of that end position is, therefore, quite large. That in turn ensures maximum assistance by the springs for the contact switching operation.

In order further to increase the speed of separation of the contacts, provision is made for the contact springs 16, 17 carrying the contacts to be designed so that, without their force exceeding the appropriate corresponding amount of the permanent magnet force arising from the premagnetization, they are adapted to store a maximum quantity of energy between their respective positions corresponding to the abutment of the armature against the poleshoes and the separation of the contacts.

The spring curve should run linear and be tangent to curve $e_o$ (point Y) in about the middle between final armature position and the point X of contact opening (when the spring force is zero). If a particular spring force is required in the final position (contact closing force), then the requirement exists that the force as determined by $e_o$ and as effective in the armature disposition corresponding to the point Y where the spring characteristic is tangent to $e_o$, must equal half of the contact closing force. Please note that the magnetic attraction force is not effective on the contacts; only the resilient force is! That tangent point is also in about half of the maximum deflection which the springs undergo.

Progressive spring characteristics may also be used for purposes of storing the maximum energy and are adapted approximately to the shape of the curve of the permanent magnet force. That however, may add to the difficulties already referred to, but there is a suitable and advantageous design available in this connection, according to which the contact springs 17, 18 together have a linear spring characteristics as illustrated. The slope of that characteristics is such that the contact springs are adapted to store a maximum amount of energy between their respective positions corresponding to the abutment of the armature against the poleshoes (stop sheets) and the separation of the contacts 16 - 14, 15 without their force exceeding the appropriate corresponding amount of the permanent magnet force arising from the premagnetization. Such contact springs meet with a satisfactory degree of approximation the requirement of high energy storage capacity when the reflected or mirror image of the spring characteristic - if the characteristic of the non-captive spring can be neglected by comparison with that of the fixed spring - makes tangential contact with the permanent magnet curve and the point of contact is situated in the middle between the point of abutting of the armature and the point of separation from the contact springs. Springs having a linear characteristic of this kind are simple to manufacture and require no complicated adjustment.

On the whole, the armature has to operate in conjunction with the sum of the forces exerted by the fixed and non-captive springs. As the fixed springs only come under tension after contact is first made, such a spring system is in general of an already progressive nature. In order to impart to such a system the maximum possible energy content without intersecting the curve of permanent magnet force, the point of making initial contact must be located very close to the end stop of the armature. This means that the overall spring-loaded stroke would be small compared with the no-load stroke of the armature, which is highly unacceptable from the point of view of stability of contact force, protection from contact burning and switching time. The contact force itself is lessened moreover by the amount of the non-captive spring force. Moreover, the rules as expounded above and concerning the location of the tangent point 4 are strictly valid only when the counter-contacts (14, 15) on the armature are not resiliently mounted thereto. In other words, the resiliency of the contact carriers 10 and 11 must be neglibly small as compared with the resiliency of contact springs 17 and 18 (when deflected away from stops 36. 37). Otherwise, the resulting spring force curve would not run in the abscissa between the points of contact making (X, $X^1$), but would exhibit a positive direction of inclination, and the armature would be subjected to still another spring force in the instant of contact opening. The knee of the resulting spring force curve would not be on the abscissa but somewhat displaced therefrom. Consequently, the spring force characteristics would have to be much flatter to avoid intersecting the curve $e_o$. A flatter spring characteristics means a reduction in available resilient energy, i.e. a reduction in area between spring characteristics and abscissa. Moreover, the contact force would be reduced because that force would only be the difference between total resilient force and resiliency of the contact carrier on the armature. All these problems will not arise if the latter resiliency is, in fact, negligibly small. Therefore, it is a significant feature that only the fixed contacts are mounted on contact springs 17, 18 and the non-captive contacts 14, 15 are secured in a non-resilient manner to armature 7. By this means not only is the maximum possible contact force made available, but also (in practice using only fixed springs with a linear spring characteristic) a large amount of energy may be stored, although the points of actual contact (X and X') are relatively remote from the respective armature stops at $S_1$ and $S_2$ and favours a larger stroke under load and a smaller total stroke of the armature 7, which is of importance for the switching time. Moreover, the non-captive contacts (14, 15) are moved positively, which affords considerable advantages in respect of contact bounce and signal sequence controlled contact. To this must be added the fact that the speed of separation of contacts is improved thereby, since the non-captive contacts cannot remain any longer in contact with the fixed contacts owing to their inertia when the armature switches over.

As was mentioned above, spacer plates or stop sheets 33 or like devices are placed on the poleshoes for forming direct abutments for the armature. Spacer plates of this nature are known per se, their object is to prevent the curve of permanent magnet force rising uncontrollably when the armature approaches its abutment. In addition to the measures already described, they thus serve in this case to linearize the curve of permanent magnet force. Furthermore, the thickness of the stop sheets 33 is to be appropriately about 1/6 of the gap between the poleshoes as defined between the armature yoke legs. It has, in fact, been shown that by thus dimensioning the stop sheets the speed of separation of the contacts is affected slightly to a favorable extent, but the switching time is very considerably shortened. Still thicker plates or stop sheets - which certainly also offer considerable advantage in respect of manufacturing tolerances - would be desirable because by this means the relay could be operated with even greater excitation force. However, this would cause the energy that could be stored in the fixed springs 17, 18 to be reduced, since the armature must be left with an adequate no-load stroke in the interval between the opening of the one contact and the closing of the other contact. From this point of view the sum of the excitation force and the spring force must, however, provide the optimal quantity of energy, in order to attain the maximum possible speed of separation of the contacts accompanied, however, with short switching times. Usually, despite the efforts to linearize the curves of magnetic force, the relays are provided with very much thinner stop sheets. Since, in fact, the curves of magnetic force are already strongly linearized by the abovementioned high resistances (reluctance) in the magnetic circuit, adequate adhesive forces are no longer obtainable. In the case of the relay according to the invention and providing for minimum magnetic resistance of the magnetic circuit, the curves of magnetic force are curved to the maximum extent, that is to say they show the sharpest rise toward the positions where the armature abuts against the stops, so that apart from the other advantages mentioned the curves of permanent magnet force in particular still provide considerable adhesive forces even when using stop sheet 33 with a relatively great thickness of 1/6 of the spacing between the poleshoes.

As can also be derived from FIG. 4, a weaker permanent magnetic force as defined by a characteristic having smaller amplitudes than $e_o$(for similar deflection paths) may result in intersection with the spring characteristics. In other words, the reflected spring force characteristics will not be tangent, but may intersect curve $e_o$ twice. Nevertheless, such two intersections would still be rather close to the illustrated tangent point Y. Such intersections means that a small range of positions exist in which the armature would not be driven back by the force of the permanent magnets towards the engagement position. However, when does this situation ever arise? Whenever the coil 5 is not energized, the armature should be and is in one or the other end position ($S_1$ or $S_2$). It will leave the position only e.g. by shaking, i.e. through a mechanical interference. However, even in the case of rather strong shaking that causes the armature to be deflected from an end position, the critical range of intersection is quite far away from the end position and the armature will not be driven into the range where the spring force is larger than the permanent magnetic attraction. This, however, will be true only if the permanent magnet characteristics rises steeply near the end positions. This then is another indication of the importance of holding the resistance of the magnetic circuit down as much as possible so as to obtain this significantly non-linear characteristics for permanent magnetic energization. While resilient contact carrierson the armature have been discouraged, the principle of the invention is nevertheless also usable here. Also, while linear spring characteristics are clearly preferred for reasons of better predictability, other characteristics could be used but should be optimized for providing for significant initial contact-opening speeds.

The invention is not limited to the embodiments described above, but all changes and modifications thereof not constituting departures from the spirit and scope of the invention are intended to be included.

I claim:

1. In an electromagnetic relay having an armature, an energizing coil, a yoke structure for completing a magnetic circuit, which includes a working air gap between the yoke structure and the armature and a premagnetization comprising the magnetic circuit having a magnetic reluctance which is very small in relation to the reluctance of the working air gap, the magnetic circuit being further constructed for a non-linear premagnetization characteristics in dependance upon the position of the armature in the air gap with flat characteristics in a median position of the armature of non-abutment with the yoke structure and steep increase of the premagnetization characteristics close to such abutment; and means for controlling the energization of the coil for at least almost completely offsetting the attraction of the armature as resulting from the premagnetization in the abutment position of the armature, with increasing energization for positions of the armature off the armature tending to move the armature further away from the previously held abutment position.

2. Relay as in claim 1 and including resiliently mounted contacts, deflected in the position of abutment of the armature and having a (reflected) resilient characteristics of deflection running at least close to the said premagnetization characteristics for positions near and in the half way position of resilient deflection in relation to the full way deflection in the abutment position.

3. Relay as in claim 1, the yoke structure having a stop sheet against which the armature abuts in the abutment position.

4. Relay as in claim 1, the yoke structure providing for two abutment positions, the non-linear characteristics being symmetrical to provide attraction for each of the abutment positions and no attractions in a median position, the armature moving in an air gap between the stop positions, narrowing the air gap by its own mass, the remainder of the air gap defining the working air gap.

5. Relay as in claim 4, the yoke structure having stop sheets against which the armature abuts in each of the abutment positions, the stop sheet having about one sixth the thickness of the working air gap.

6. Relay as in claim 1 and including contact springs carrying contacts and being designed so that their force does not exceed the corresponding value of the attraction force generated by the premagnetization, said springs being adapted to store a maximum amount of energy between their respective positions corresponding to the armature stop and the opening of the contacts.

7. Relay as in claim 1, and including contact springs having a linear spring characteristic, the slope of which being selected, so that said springs, without their force exceeding the appropriate corresponding value of the permanent magnet force as provided by the premagnetization, being adapted to store a maximum amount of energy between their respective positions corresponding to the armature stop and the opening of the contacts.

8. Relay as in claim 7, wherein the contacts on the contact springs are mounted to the yoke structure and non-captive contacts of the relay being secured to the armature without springs.

9. Relay as in claim 1 comprising iron cross-sections in the yoke structure for ensuring the magnetic distance of the poleshoes is small in relation to that of the working air gap.

10. In an electromagnetic relay having a swivel armature in an energizing coil and a yoke structure completing a magnetic circuit through the armature and which includes a working air gap between the yoke structure and the armature, the yoke structure further defining two alternatives stop positions of abutment with the armature, a first set of contacts on the armature cooperating with a second and a third stationarily mounted set of contacts for contact making respectively in the two stop positions, the magnetic circuit including means for biasing the magnetic circuit, the improvement comprising:

the yoke structure providing for abutment with the two opposite ends of the armature in each of the stop positions;

a pair of excentrically mounted journal disks for journalling the armature;

the magnetic circuit having a magnetic reluctance which is very small in relation to the reluctance of the working air gap, the magnetic circuit without coil energization providing for non-linear attraction of the armature in dependence upon its displacement within the range between and including the two stop positions with rapidly increasing attraction in positions adjacent to the stop positions and zero and near-zero attraction in a median position of the armature between the two stop positions;

means for resiliently mounting at least one of the set of contacts to provide contact pressure and tending to remove the armature from either stop position; and means for energizing the coil to provide electromagnetic energization in the magnetic circuit in one of the other direction whereby for particularly directed energization and in each of said stop positions the bias magnetization is overcome when the armature is still in the respective stop position, so that the armature is propelled out of the stop position towards the other stop position by combined action of the resilient means and the electromagnetic energization.

11. In a relay in claim 10, wherein the armature has a magnetisable shaft, traversing the shaft and being mounted in said disks, the disks being non-magnetic.

12. In a relay as in claim 10, wherein the second and third sets of contacts are resiliently mounted by said means for mounting and having together a linear or near linear spring force characteristics being in at least one point very close to or even equal to a point or portion of magnetisation characteristics as provided by the magnet circuit.

13. In an electromagnetic relay having a swivel armature in an energization coil and a yoke structure with air gap means and completing a magnetic circuit through the armature and defining two alternative stop positions of abutment with the armature, a first set of contacts on the armature cooperating with a second and a third stationarily mounted set of contacts for contact making respectively in the two stop positions, the magnetic circuit including means for biasing the magnetic circuit, the improvement comprising:

the yoke structure providing for abutment with the two opposite ends of the armature in each of the stop positions;

the magnetic circuit having a magnetic reluctance which is very small in relation to the reluctance of the air gap means, the biasing means, wihtout coil energization, providing for non-linear attraction of the armature in dependence upon its displacement within the air gap means and in a range between and including the two stop positions with rapidly increasing attraction in positions adjacent to the stop positions and zero and near-zero attraction in a median position of the armature between the two stop positions;

means for resiliently mounting at least one of the set of contacts to provide contact pressure and tending to remove the armature from either stop position; and means for energizing the coil to provide electro-magnetic energization in the magnetic circuit in one or the other direction, whereby for particularly directed energization and in each of said stop positions the bias magnetization is overcome when the armature is still in the respective stop position, so that the armature is propelled out of the stop position towards the other stop position by combined action of the resilient means and the electromagnetic energization.

14. In a relay as in claim 13, wherein the armature carries contacts with relatively small resilient deflection, the contacts as resiliently mounted having substantially linear spring force characteristics running close to a curving portion of the non-linear attraction characteristics in about the middle of total deflection by engagement with the armature contacts.

15. In a relay as in claim 13, there being stop sheets on the yoke structure, against which the armature abuts in each stop position, leaving a residual distance between the armature and the yoke structure for limiting the attraction as resulting from the permanent magnetic bias.

16. In a relay as in claim 13, the biasing magnetization being provided by permanent magnets.

17. Electromagnetic relay comprising:

a magnetic energizing circuit including a permanent magnet, magnetizing coil means, an armature and a yoke structure disposed for selective abutment with the armature, the permanent magnet causing the armature to be held in abutment with the yoke structure in the absence of energization of the coil means, the magnetic circuit having magnetic reluctance which is negligibly small to the reluctance of the working air gap between armature and yoke structure; and means for operating the magnetizing coil means to provide maximum force to the armature to move the armature out of the position of abutment.

18. Relay as in claim 17, the yoke structure having a stop sheet about one sixth the size of the said air gap.

19. Relay as in claim 17 and including resilient means acting on the armature in direction opposite to the force holding the armature in abutment with the yoke.

* * * * *